United States Patent [19]

Wakabayashi

[11] 4,058,919

[45] Nov. 22, 1977

[54] SEGMENT TYPE, ELECTRIC LIGHT ALPHA-NUMERIC FIGURE INDICATOR

[76] Inventor: Yasuo Wakabayashi, 17-7, Hisaki 8-chome, Zushi, Kanagawa, Japan

[21] Appl. No.: 737,005

[22] Filed: Oct. 29, 1976

[51] Int. Cl.[2] ..... G09F 13/00

[52] U.S. Cl. ..... 40/130 E; 40/132 D

[58] Field of Search ..... 40/130 D, 130 E, 132 D

[56] References Cited

U.S. PATENT DOCUMENTS

| | | | |
|---|---|---|---|
| 950,309 | 2/1910 | Stiprowitsch | 40/130 D |
| 1,586,464 | 5/1926 | Pearson | 40/130 D |
| 2,230,152 | 1/1941 | Wolfrey | 40/130 E |
| 3,137,082 | 6/1964 | Phlieger | 40/130 E X |
| 3,187,320 | 6/1965 | Kupsky | 40/130 E X |
| 3,210,876 | 1/1966 | Towne | 40/130 E X |
| 3,261,013 | 7/1966 | Naylor | 40/130 E X |
| 3,675,242 | 7/1972 | Hammel | 40/130 E X |
| 3,739,512 | 6/1973 | Kupsky | 40/130 E X |
| 3,858,341 | 1/1975 | Wakabayshi | 40/130 E |

*Primary Examiner*—Russell R. Kinsey
*Assistant Examiner*—Wenceslao J. Contreras
*Attorney, Agent, or Firm*—Lane, Aitken, Dunner & Ziems

[57] ABSTRACT

A segment type, electric light figure indicator including a casing defining a plurality of flat compartments wherein at least one of the compartments is sub-divided into a plurality of sub-compartments. Each sub-compartment has a cross-section in a lateral plane in the shape of a triangle, the bases of triangles being substantially linearly aligned. At least one light source is mounted in each sub-compartment in the apex angle of the triangle. A cover plate covers the top opening of the casing and has a plurality of slots which permit light emanating from the light sources to shine through, at least one of the slots being located parallel to, in front of and coextensive with the aligned bases of the triangles of the sub-compartments. The sub-compartments each have a reflecting wall inclined to the cover plate at an angle of about 15° to 75°, the inclined wall being located immediately behind the slot coextensive with the aligned triangle bases. The slots are arranged so as to collectively form a desired figure.

4 Claims, 11 Drawing Figures

SEGMENT TYPE, ELECTRIC LIGHT ALPHA-NUMERIC FIGURE INDICATOR

BACKGROUND OF THE INVENTION

1. Field of the Invention

This invention relates to a segment type, illuminated figure indicator and more particularly to an improved construction of the casing of the electric light figure indicator shown in my U.S. Pat. No. 3,858,341.

2. Description of Prior Art

The segment figure indicator disclosed in my U.S. Pat. No. 3,858,341, when constructed in a large size with small electric light sources does not provide a uniformly bright illuminated segment nor does it provide a mechanically strong casing. For example, it is rather difficult to construct a large electric light figure indicator of my prior design with tiny electric light sources such as light emitting diode (LED) chips which will provide uniform brightness and a strong construction.

SUMMARY OF THE INVENTION

It is a principal object of the present invention to provide a large-scale segment type electric light alpha-numeric figure indicator or a good optical efficiency and a strong construction which provides the advantages of my earlier design, i.e., minimized thickness or depth of the casing as well as uniform brightness throughout the entire length of each elongated figure segment, even when provided with only tiny electric light sources such as LED chips.

The indicator of the present invention includes a housing having a plurality of flat compartments and a front wall containing a plurality of light transmissive slots each of which defines an alpha-numeric figure segment. Each of said slots is associated with one of said compartments, and individual electric light sources are provided in each compartment for producing light which issues through the associated slot. At least one of the compartments is subdivided into a plurality of triangles arranged in a row in cross-section, taken in a plane parallel to said front wall, each triangle having an apex angle and a base opposite said angle, the bases of the triangles ajoining substantially in line. Electric light sources provided in each compartment are each located adjacent the apex angle of one of the triangles. The slot associated with the compartment extends along the bases of the triangles opposite or above a reflective surface inclined to the front wall and the triangle base at an angle of about 15° to 75° so as to reflect light from the compartment through the associated slot.

The above mentioned and other objects and features of the present invention will become apparent from the following detailed description taken in conjunction with the drawings which show several embodiments of the present invention.

BRIEF DESCRIPTION OF THE DRAWINGS

FIG. 1(*b*) is a cross-sectional view of the indicator of FIG. 1(*a*), taken along line A—A thereof;

FIG. 1(*c*) is a front elevation, partially in cross-section, of the device of FIGS. 1(*a*) and (*b*);

FIG. 2(*b*) is a cross-sectional view of the indicator of FIG. 2(*a*), taken along line B—B thereof;

FIG. 2(*c*) is a front elevation, partially in cross-section, of the device of FIGS. 2(*a*) and 2(*b*);

FIG. 3(*b*) is a front elevation, partially in cross-section, of the device of FIG. 3(*a*);

FIG. 4(*b*) is a cross-sectional view of the indicator of FIG. 4(*a*), taken along line C—C thereof; and FIG. 4(*c*) is a front elevation, partially in cross-section, of the device of FIGS. 4(*a*) and 4(*b*).

DETAILED DESCRIPTION OF THE INVENTION

Figure 1A:
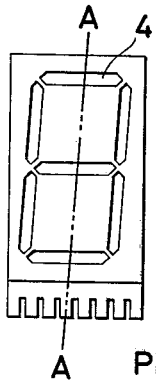
FIG. 1(*a*) is a front elevation of the seven segment electric light figure indicator of the type disclosed in U.S. Pat. No. 3,858,341.
Figure 1B:
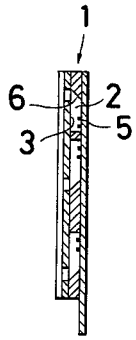
PRIOR ART Fig.1b
Figure 1C:
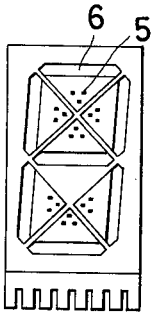
PRIOR ART Fig.1c

FIGS. 1(*a*), 1(*b*) and 1(*c*) illustrate a large segment type illuminated figure indicator of the type disclosed in my U.S. Pat. No. 3,858,341 for comparison and better understanding of the features of the indicator of the present invention. The casing 1 has seven flat compartments 2 and a front wall 3 containing light transmissive slots 4 each of which defines a character segment and is associated with one of the flat compartments 2. An electric light source in the form of three tiny LED chips 5 is housed in each compartment 2 for producing light which issues through the associated slot 4. Each compartment 2 has a substantially triangular shape in cross-section taken in a plane parallel to the front wall 3. The slot 4 extends along one side of the triangle and the three LED chips 5 are located adjacent the triangle apex opposite the side associated with slot 4. Each compartment 2 has a reflective surface 6 located at the side of the triangle associated with slot 4 and inclined relative to the front wall 3 so as to reflect light produced in the compartment 2 out through slot 4.

The construction of this casing provides an undesirably long optical distance between the light transmissive slot 4 and the light source, the three tiny LED chips 5, so that the illuminated figure is insufficiently bright. Aslo each flat compartment 2 is covered by a relatively wide expanse of a very thin front wall 3, which will be easily broken or bent if pressed.

Figure 2A:
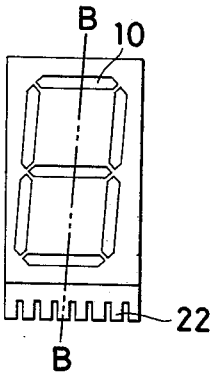
PRIOR ART Fig.2a
FIG. 2(*a*) is a front elevation of a segment type, electric light figure indicator according to one embodiment of the present invention.
Figure 2B:
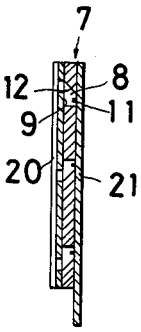
Figure 2C:
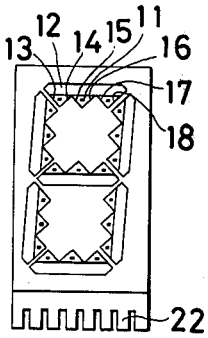

FIGS. 2(*a*), 2(*b*) and 2(*c*) illustrate a segment type illuminated large figure indicator of the present invention. The casing 7 contains seven flat compartments 8, and has front wall 9 which contains a seven light transmission slots 10, each of which defines an alpha-numeric figure segment. Each compartment 8 is subdivided into three substantially triangular sections aligned in a row in a cross-section taken in a plane parallel to the front wall 9. The bases of the three triangles are aligned substantially linearally. Individual tiny LED chips 11 are housed in the apex angle opposite the aligned base of each of the three triangles of the compartment 8. Each light transmission slot 10 extends along the line formed by the bases of the three triangles. Each flat compartment 8 has an elongated reflective surface 12 at its aligned base, behind the associated slot 10 and inclined to the front wall 9 at an angle of about 15° to about 75°, preferably about 45°, so as to reflect light produced within the compartment 8 through the associated slot 10. It is preferred that the surfaces 13, 14, 15, 16, 17, 18 and 9 defining each compartment 8 be coated with aluminum or chromium plating to form highly reflective surfaces. Over the front wall 9 is provided a light diffusing member in the form of a semi-transparent white or frosted glass sheet 20. Respective tiny LED chips 11 are bonded directly onto the printed circuit base board 21 to minimize the thickness or depth of the display device. A connecting terminal 22 is also provided as an extension of the base board 21.

In operation, when all tiny LED chips 11 in a selected compartment 8 are lit, the light therefrom is reflected off of the various reflecting surfaces 12, 13, 14, 15, 16, 17, 18 and 9 and eventually issues through the associated slot 10 to illuminate the semi-transparent sheet 20 from behind with an uniform intensity of illumination. A much shorter optical distance between the light transmissive slot 10 and each LED chip 11 is attained in the design of the present invention than that shown in FIGS. 1(*a*), 1(*b*), and 1(*c*), so that the brightness of the indicated figure on the display surface of the device of the present invention is much brighter.

The interior space of each compartment 8 of the present invention is about ⅓ that of compartment 2 of the prior art device shown in FIGS. 1(*a*), 1(*b*) and 1(*c*). Accordingly, the area of the front wall 9 covering each flat compartment 8 is also about ⅓ of that for the prior art device shown in FIGS. 1(*a*), 1(*b*) and 1(*c*), so that the mechanical strength of the front wall 9 is much stronger than the front wall 3 of the prior art design, and is able to better resist damage due to impact.

Figure 3A:
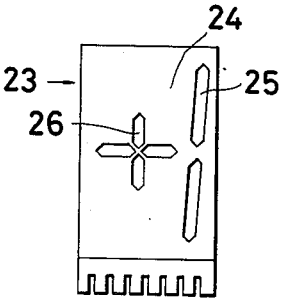
FIG. 3(*a*) is a front elevation of another embodiment of the present invention.
Figure 3B:
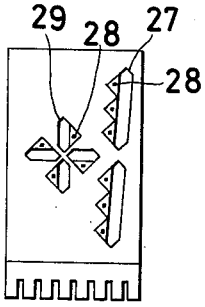

FIGS. 3(*a*) and 3(*b*) show another casing 23 of an indicator of the present invention, which shows a small polarity figure and a big numerical figure 1 together. The front wall 24 contains both relatively long light transmissive slots 25 and shorter light transmissive slots 26. The longer light transmissive slots 25 are associated with larger flat compartments 27 which have the same construction and an optical function as the compartments 8 described in connection with FIGS. 2(*a*), 2(*b*) and 2(*c*). The shorter light transmissive slot 26 is associated with a smaller flat compartment 29 which has a substantially triangular shape in a cross-section taken in a plane parallel to the front wall 24, and a LED chip 28 is housed in the apex angle of this triangular shape. The construction of this shorter light transmissive slot 26 and the smaller flat compartment 29 is similar to the indicator of my U.S. Pat. No. 3,858,341. Thus, the present invention provides large and bright electric light figure indicators for complicated alpha-numeric figures.

Figure 4A:
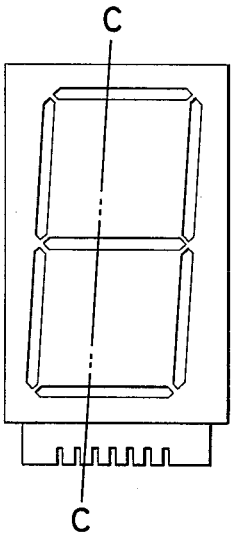
FIG. 4(*a*) is a front elevation of a larger embodiment of the device of the present invention.
Figure 4B:
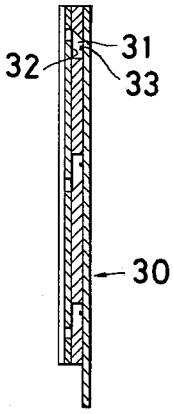
Figure 4C:
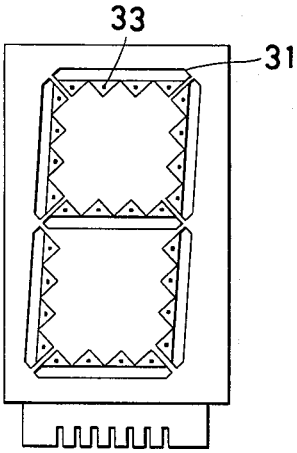

FIGS. 4(*a*), 4(*b*) and 4(*c*) show a much larger segment type brightly illuminated figure indicator according to the present invention. The casing 30 of this indicator provides the same optical function as the indicator device of the present invention shown in FIGS. 2(*a*), 2(*b*) and 2(*c*), but compartment 31 differs from compartment 8 of the previously described embodiment in that each compartment 31 is subdivided into four triangles arranged in a row in a cross-section taken in a plane parallel to the front wall 32 instead of three triangles as in the embodiment of FIGS. 2(*a*), 2(*b*) and 2(*c*). Each of the four trianglar subcompartments has an apex angle and a base opposite the apex angle with individual LED chips 33 located in each apex angle as in the earlier described embodiments.

Thus, the present invention provides a large and bright figure indicator, which has both good optical efficiency and good mechanical strength, in a casing of shallow depth.

The foregoing description and examples are presented for purposes of illustration only and are not intended to limit the scope of the invention as defined by the appended claims.

What is claimed is:

1. A segment type, electric light figure indicator, comprising:

a casing for housing the indicator.

a cover plate disposed over said casing and having a plurality of light-transmissive slots arranged to collectively form the desired figure;

a plurality of compartments disposed within said casing and positioned behind at least one of said slots, each of said compartments having a triangular cross section in a plane parallel to said cover plate with a base side and an apex angle opposite said base side, the base sides of said plurality of compartments being linearly aligned and coextensive with said one slot;

each of said compartments having a reflecting wall inclined to said cover plate at an angle of about 15° to 75° and being disposed immediately behind said one slot; and at least one light source housed in each of said compartments and positioned adjacent to the apex angle.

2. The figure indicator of claim 1 wherein the interior surfaces of each compartment are light reflective.

3. The figure indicator of claim 1 further comprising a printed circuit board forming the base of said casing wherein the lead wires of said light sources are bonded or soldered to said printed circuit board.

4. The figure indicator of claim 3 further comprising, as an extension of the printed circuit board, a connecting terminal.

* * * * *